United States Patent [19]

Crowe

[11] Patent Number: 4,850,642

[45] **Date of Patent: * Jul. 25, 1989**

[54] BOOTH SEATING SYSTEM

[75] Inventor: Scott D. Crowe, 45 Jody La., Camarillo, Calif. 93010

[73] Assignee: Scott D. Crowe, Camarillo, Calif.

[ * ] Notice: The portion of the term of this patent subsequent to May 3, 2000 has been disclaimed.

[21] Appl. No.: 757,915

[22] Filed: Jul. 22, 1985

Related U.S. Application Data

[63] Continuation of Ser. No. 589,051, Mar. 15, 1984, which is a continuation of Ser. No. 261,801, May 8, 1981.

[51] Int. Cl.[4] ..... A47B 39/00

[52] U.S. Cl. ..... 297/158; 297/244; 108/91

[58] Field of Search ..... 297/158, 157, 244; 108/91; 76/43, 45, 191

[56] References Cited

U.S. PATENT DOCUMENTS

| | | | |
|---|---|---|---|
| D. 228,162 | 8/1973 | Fink | D6/45 |
| D. 268,801 | 5/1983 | Crowe | D6/191 |
| 1,515,760 | 11/1924 | Small | 297/244 |
| 1,978,512 | 10/1934 | Stone | 297/158 |
| 2,261,506 | 11/1941 | Scott | 297/244 |
| 2,478,118 | 8/1949 | Mills | 297/158 |
| 3,020,087 | 2/1962 | Macklin | 297/244 |
| 3,171,685 | 3/1965 | Hershberger | 297/158 X |
| 3,326,148 | 6/1967 | Jakobsen | 108/91 |
| 3,847,424 | 11/1974 | Nielsen | 297/158 |
| 3,847,431 | 11/1974 | Nielsen | 297/158 |
| 3,858,933 | 1/1975 | Koehring | 297/158 |
| 4,023,859 | 5/1977 | Hagenson | 297/158 |

*Primary Examiner*—Francis K. Zugel
*Attorney, Agent, or Firm*—Edward J. DaRin

[57] ABSTRACT

A universal table A-frame that is constructed as a unitary structure for use in a booth seating system including a series of booths. The A-frame is a basic module for the booth seating system. The A-frame includes a pair of spaced apart frame rails arranged in a longitudinal parallel relationship and in the same horizontal plane by means of legs secured to the rails adjacent the ends of the rails. The A-frame includes a pair of elements that are individually secured to the inner edge of one of the rails and each extends upwardly towards the other rail. A horizontal frame element is secured in a cantilevered relationship to the free ends of the pair of elements to thereby complete the frame. The horizontal element is adapted to mount a table top. The legs of the A-frame may be offset for permitting the stacking of the A-frame in a nesting relationship. The frame rails are also provided with mounting plates for permitting the longitudinal adjustability of the frames. A booth seating system is defined through the use of the A-frame by securing seating means to the individual frame rails.

16 Claims, 3 Drawing Sheets

BOOTH SEATING SYSTEM

This application is a continuation, of application Ser. No. 589,051, filed 3/15/84, and which application is a continuation of Ser. No. 261,801, which was filed on May 8, 1981.

FIELD OF THE INVENTION

This invention relates to booth seating systems and more particularly to a universal A-frame structure for the booth seating systems.

BACKGROUND OF THE INVENTION

Various types of booth seating systems are presently commercially available and are in the prior art. These booth seating systems are presently used in fast-food outlets which are usually associated with a parent organization having outlets nationwide. In these types of nationwide food outlets, the basic construction of the outlet is the same and so it is designed to have booth seating systems that are the same throughout the country. These types of seating systems are also used in local restaurants and fast-food outlets. Typical prior art patents which disclose a cantilevered table in combination with a booth are U.S. Pat. Nos. 1,903,954; 2,478,118; 2,509,332; 3,574,394; 3,847,424; 3,847,431 and 4,023,859. Of particular interest are the Neilson U.S. Pat. Nos. 3,847,424 and 3,847,431 and the Hagenson U.S. Pat. No. 4,023,859 concerning the basic frame and table supporting structure. Similar seating units are presently in use and commercially available for both inside and outside seating units for both single-sided and double-sided seating.

To my knowledge, most of the present commercially available booth seating systems are not constructed in modular form to be readily shipped and therefore must be assembled in a more or less custom basis at the point of installation of the booth systems through the utilization of installation contractor labor. The installation of such prior art booth systems is essentially custom fitted to the particular area available for the seating system. Generally, these prior art booth seating systems are fixed in length, and nonadjustable, and must be adapted on site to properly fit into the alotted area in the structure in which it is installed. There is presently commercially available a booth seating system that provides booth length adjustability through the use of telescoping structural elements for the booth system. These types of adjustable systems have been found to be inherently unstable since they allow the table secured thereto to "droop" due to improper placement of fasteners and the inherently loose fit up of telescopic tubes which permits lateral and rotational movement of the telescoped structural elements.

It is advantageous to define the basic elements of the booth seating system not only in modular form but also stackable for economy in handling and shipping. Stackable tables and seating elements are known in the prior art and are exemplified by the following prior art patents: U.S. Pat. Nos. 2,362,426; 2,842,412; 2,871,073; and 3,326,148. These patents disclose structures that are provided with offset legs to render them stackable. As applied to a simple table having offset legs, the Jakobsen U.S. Pat. No. 3,326,148 is of particular interest.

SUMMARY OF THE INVENTION

The present invention provides an improved booth seating system utilizing a universal table A-frame constructed of one-piece and readily capable of being stacked for shipping and handling. The universal frame (no lefts or rights) includes reliable adjustable means to permit the length of the booths to be readily customized at the point of installation without the need for custom fabrication and the attendant costs. The one-piece, welded construction of the booth A-frame virtually eliminates frame failures such as the collapse of the table top or the seating unit due to misassembly or fastener failure. The basic A-frame module provides maximum support and stiffness and is adapted to fully support a table top without the need for leveling or further assembly other than securing the table top to the frame. The A-frame module is utilized with a modular seating unit that can be assembled at the factory and mounted with the A-frame readily at the point of use to reduce the assembly time and cost along with the elimination of most assembly errors. An independent and universal, i.e., no lefts or rights, seat frame is provided for the seating module so that it can be readily and adjustably secured to the basic A-frame on site and permits factory assembly of the seat upholstery and any associated decorative trim. These essentially "off-the-shelf" modules can be economically produced to have the advantage of the custom unit without the associated high cost or long delivery times normally associated with a customized unit. The inherent stability of the A-frame module along with the minimum reliance on mechanical fasteners for structural integrity provides safety to the users of the booth system. These latter features also minimize the reliance on field labor to perform a cost-effective, accurate, fast and safe assembly of modules. The assembly time is approximately one-half the time required for prior art booth systems.

From a structural standpoint the invention comprehends a universal table A-frame for booth seating systems comprising a pair of spaced-apart frame rails adapted to be arranged in a parallel relationship and with their top surfaces defined in the same horizontal plane. A leg is secured adjacent each end of each rail for maintaining the frame rails at a preselected vertical seating level and in the same horizontal plane. An A-frame structure is secured to each rail adjacent an end thereof to secure the rails in their rigid upstanding relationship therewith. The A-frame structure comprises a pair of frame elements each being secured in a cantilevered relationship adjacent the same ends of each rail and disposed in an upwardly inclined relationship therewith and extending in a direction toward the other rail of the pair of rails. The frame also includes table top mounting means secured to the free ends of said cantilevered frame elements for providing a unitary structure with the pair of frame elements and the pair of frame rails. The table mounting means further comprises a third frame element extending in a cantilevered relationship from the free ends of the pair of frame elements and is secured between the pair of frame rails in a pre-selected horizontal plane above the plane of the frame rails and adapted to secure a table top. The universal A-frame is advantageously defined wherein a leg for each rail is mounted in a flush relationship or in the same vertical plane as the rail and the other leg for each rail is mounted in an off-set relationship or spaced from the vertical plane to permit a plurality of said thus defined table A-frames to be readily stacked in a nesting relationship for handling and shipment. The frame rails each include means for adjustably securing a seating unit adjcent each end of the rails in a preselected horizontal seating level. The adjustment means may comprise a plate having a plurality of spaced, aligned securing apertures adjacent each end of the rails and terminating at the same horizontal plane.

The universal booth seating system comprises a unitary frame structure for mounting seating means in oppositely facing directions for the same booth. The frame structure comprises a pair of spaced apart frame rails adapted to be arranged in a parallel relationship and with their top surfaces defined in the same horizontal plane. A leg is secured adjacent each end of each rail for maintaining the frame rail at a preselected vertical seating level and in the same horizontal plane. An A-frame structure comprising a pair of frame element are secured in a cantilevered relationship adjacent the ends of each rail and disposed in an upwardly inclined relationship therewith toward the other rail of the pair of rails. The A-frame includes table top mounting means secured to the free ends of the cantilevered frame elements for completing the unitary frame structure. The table top mounting means comprises a third frame element extending in a cantilevered relationship from the free ends of the pair of A-frame cantilevered elements in a preselected horizontal plane above the plane of the frame rails and adapted to secure the table top on the third frame element. The table top is secured to said table top mounting means and a pair of seating means is secured to an individual one of said frame rails with the seating means facing in opposite directions on opposite sides of the table top for defining a booth. The seating means may advantageously be upholstered seating means with both the seating area and back rest area being either upholstered, molded plastic components, or other suitable fabricated material.

These and other features of the present invention may be more fully appreciated when considered in the light of the following specification and drawings, in which.

DETAILED DESCRIPTION

Figure 1:
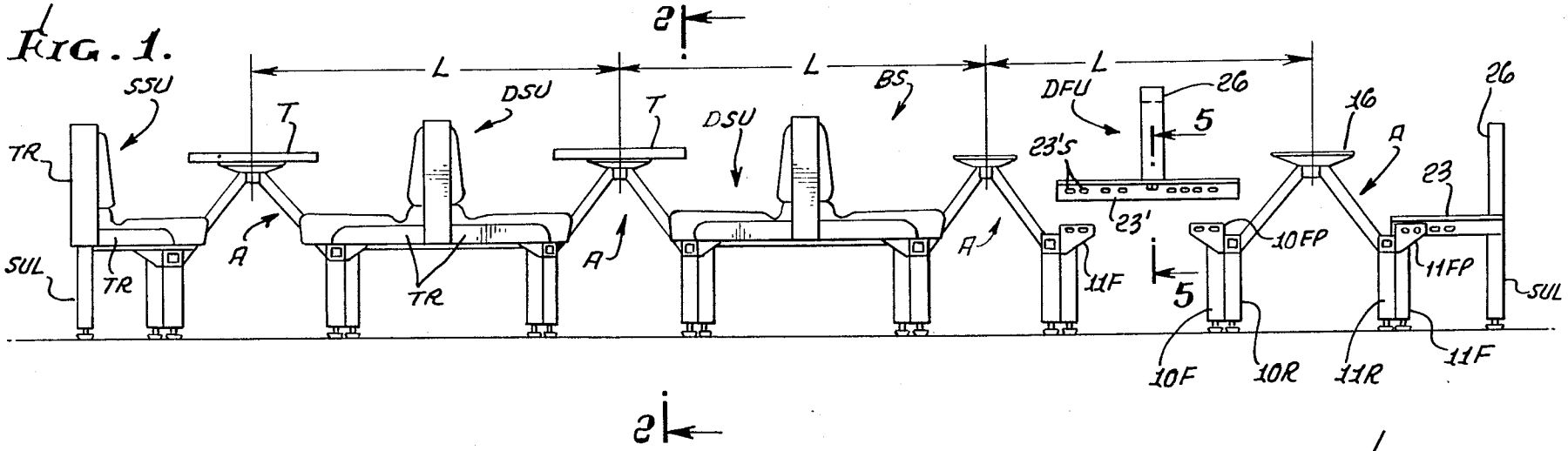
FIG. 1 is a front elevational view of the booth seating system embodying the invention and with a portion of the illustration showing the basic modules in an exploded relat and the seating units stripped of the upholstery.
Figure 5:
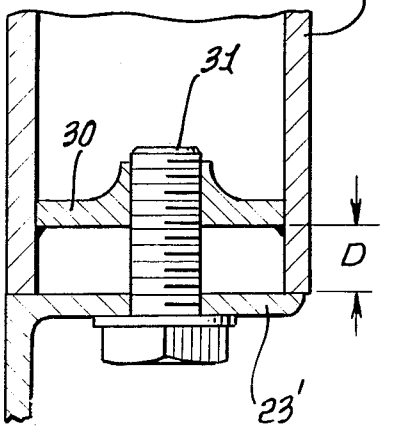
FIG. 5 is a sectional view taken along the line 5—5 of FIG. 1 and illustrates the method of securing two elements together.
Figure 2:
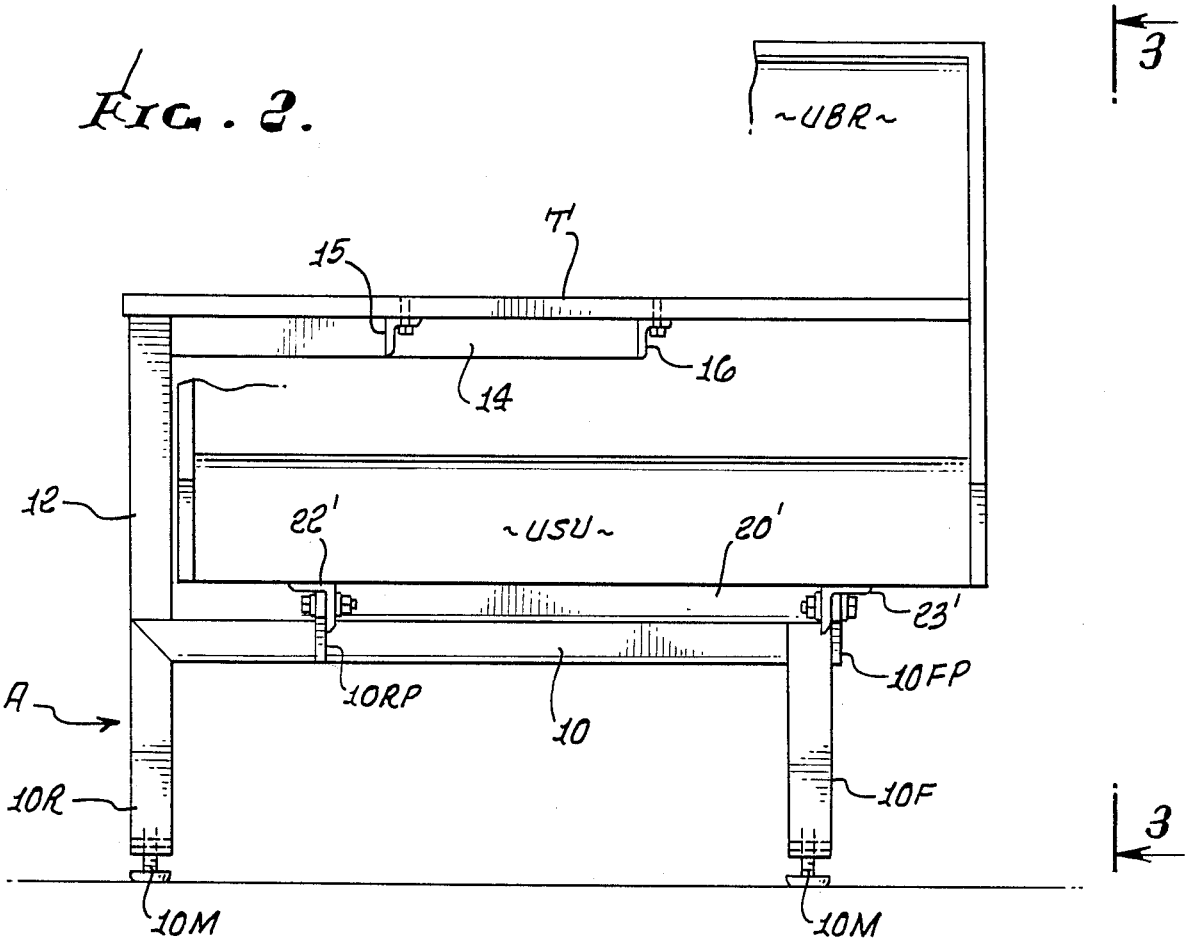
FIG. 2 is a view taken along the line 2—2 of FIG. 1.
Figure 3:
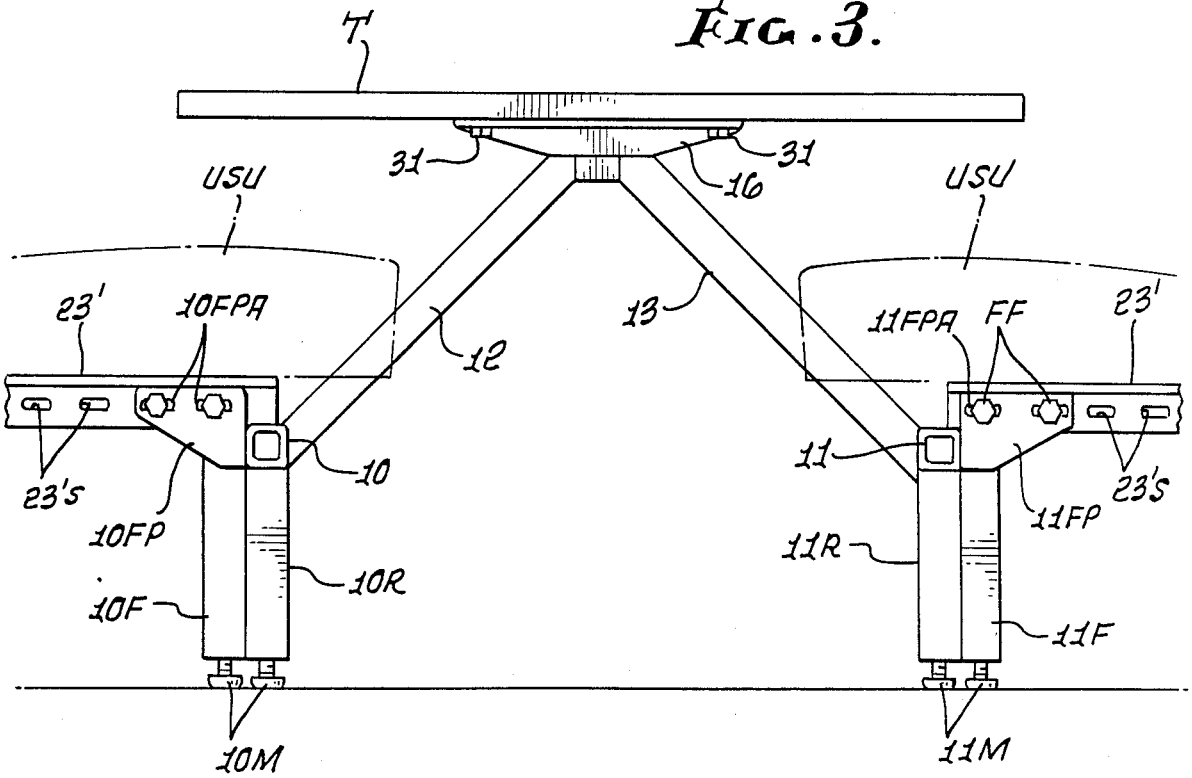
FIG. 3 is an elevational view taken along the line 3—3 of FIG. 2
Figure 4:
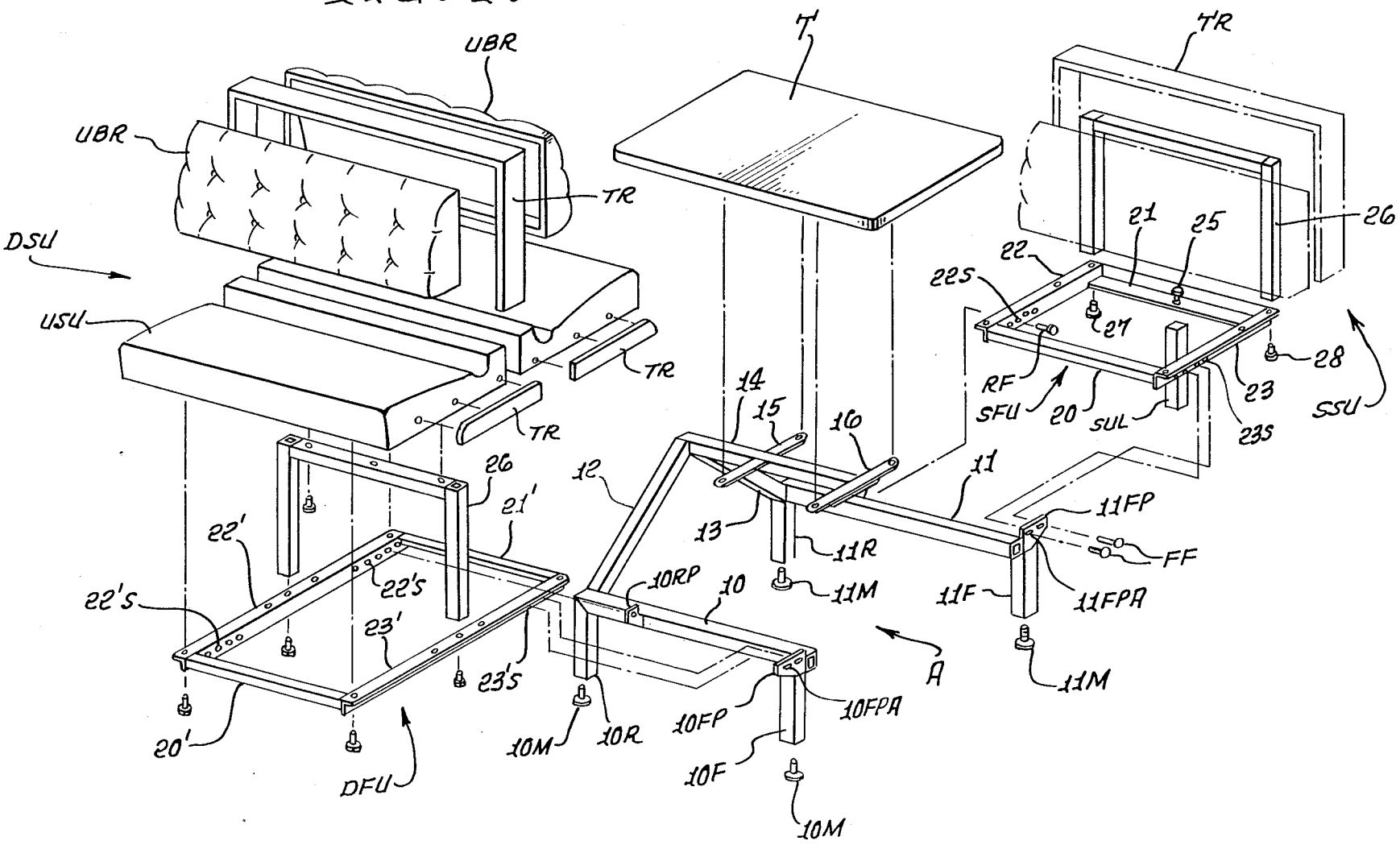
FIG. 4 is an exploded view of the modular elements and associated components of an end seating unit with a double seating unit for use with the adjacent booth as illustrated in FIG. 1.

Now referring to the drawings, the improved booth seating system BS will be described in detail. The booth seating system BS comprises three basic elements; namely, a universal A-frame A, a table top T, and a seating unit SU, which may be either a single seating unit SSU or a double seting unit DSU. The seating units SU are constructed and defined on the basis of a single frame unit SFU having a removable leg SUL. The seating units SU are also universal; no lefts or rights. The single frame seating unit SFU is utilized at the ends of the booth system BS wit the double seating units DSU used for successively adjacent units between the ends as illustrated in FIG. 1. The frame units SFU and DFU are the basic frames for receiving the upholstered seating units USU and the upholstered back rest UBR and which are secured thereto. The seating units may be provided with ornamental trim elements TR as illustrated in FIGS. 1 and 4, for example:

The details of the universal A-frame A will now be examined in detail. The A-frame A is the basic module of the booth seating system BS and is defined as a universal element, that is, no right hand units or left hand units need be considered. The A-frame A includes a pair of spaced apart frame rails 10 and 11 arranged in a longitudinal parallel relationship and in the same horizontal plane. The rails 10 and 11 can be constructed of hollow, square structural elements such as 2 inch×2 inch elements. Each rail 10 and 11 has a leg secured adjacent the ends thereof. The rear leg for the rail 10 is identified as the rail 10R while the front leg is identified as 10F. Similarly, the legs for the rail 11 are identified as rear leg 11R and 11F for the front leg. The rear legs 10R and 11R are mounted in a flush relationship or in the same vertical plane as the rails, as illustrated in FIG. 4. The front legs 10F and 11F are offset from the rails 10 and 11 respectively, and from the rear legs 10R and 11R, by being secured to the outside surfaces of the rails 10 and 11 respectively. Each of the legs 10R, 10F, 11R and 11F are provided with mounting feet for supporting the A-frame on a mounting surface. The mounting feet for the rail are identified as the feet 10M, while the mounting feet for the rail 11 are identified as the feet 11M. The feet 10M and 11M are secured to the four legs of the A-frame as illustrated in FIG. 5 and will be discussed in more detail hereinafter.

The A-frame A also includes a hollow structural element of the type of the rails 10 and 11 welded to the rear ends of each rail 10 and 11 and to angularly extend outwardly therefrom in a cantilevered relationship at an angle of approximately 45 degrees with the rails 10 and 11. The structural elements 12 and 13 are secured to the inner edges of the rails 10 and 11 respectively to extend angularly upwardly therefrom and towards the opposite rail. A similarly defined structural element 14 is secured in a cantilevered relationship between the free ends of the elements 12 and 13 by welding and arranged in a horizontal plane to complete the A-frame. The top surface of the element 14 is arranged to be parallel to the top surface of the rails 10 and 11 for providing a mounting surface for the table top T. The table mounting element 14 has a pair of cross members 15 and 16 secured thereto for securing the table top T thereto. The cross member 16 is secured to the element 14 adjacent the free end thereof while the cross member 15 is secured intermediate the ends of the element 14. Each of the cross members 15 and 16 are provided with apertures for securing the table top T thereto by means of fasteners, as is evident from examining the drawings.

Figure 7:
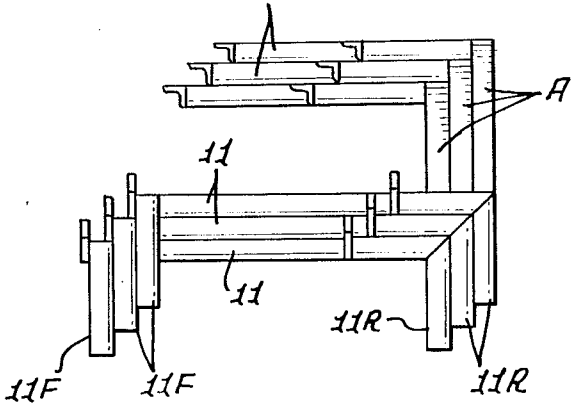
FIG. 7 is a view taken along the line 7—7 of FIG. 6.
Figure 6:
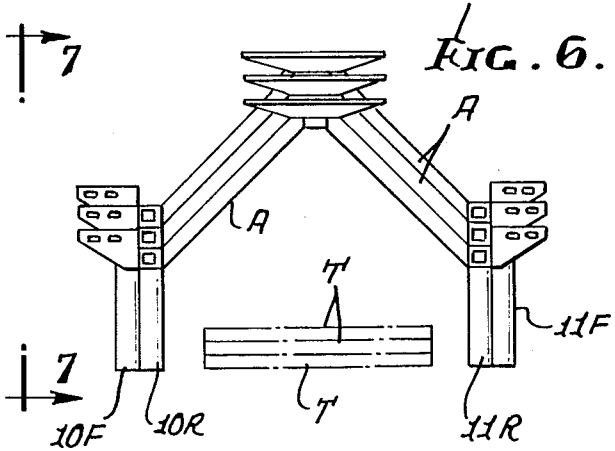
FIG. 6 is a front elevational view of a plurality of stacked A-frame units.

It should be noted that an important feature of the A-frame is the arrangement of the offset legs 10F and 11F. The provision of the legs 10F and 11F in an offset relationship or spaced outwardly from the vertical plane of the outside faces of the rails 10 and 11 permits the plurality of the A-frames A to be stacked in a nesting relationship, as can be appreciated from examining FIGS. 6 and 7. The A-frames can then be stacked by placing one A-frame A on top of an A-frame A resting on the ground by approaching the frames A from the rear thereof to stack them up in any desired number at the factory for ease of handling and shipment. In the shipping of the stacked frames A, the table tops T can be stacked in the space on the inside of the A-frames A, as illustrated in dotted outline in FIG. 6, for shipping purposes resulting in economies in space for shipping.

Another important feature of the A-frame A is the provision of the pair of mounting plates secured to each of the rails 10 and 11. The front mounting plate 10FP for the rail 10 is secured to the front leg 10F and is provided with a plurality of longitudinally aligned, spaced mounting apertures 10FPA. Similarly, a rear mounting plate 10RP having a single slot is secured, by welding, to the outside face of the rail 10 intermediate the ends thereof, as is evident from FIG. 4. The rail 11 is provided with a front mounting plate 11FP secured to the leg 11F and provided with mounting apertures 11FPA along with the rear mounting plate 11RP. The front mounting plates 10FP and 11FP are longitudinally aligned to secure a seating unit and the rear plates 10RP and 11RP are similarly longitudinally aligned and defined. The mounting plates 10FP, 10RP, 11FP, and 11RP are illustrated as spaced slotted apertures for providing infinite adjustment but also could be spaced round apertures to provide incremental adjustment or pierced apertures.

Referring now to FIG. 4 in particular, the modular assembly of the seating units SU Will be described for both the single seating units SSU and the double seating units DSU. The single seating unit SSU will first be described. The single seating unit SSU is constructed on the basis of the single frame unit SFU which consists of an angle structural element 20 and an angle element 21, both elements being the same length and arranged in a parallel spaced apart relationship. These elements 20 and 21 are secured together by a pair of angle elements 22 and 23 to form a rectangle. The angle elements 22 can be considered the rear element and the element 23 can be considered the front element. The elements 20, 21, 22 and 23 are all welded together to define the rigid single frame unit SFU. The angle elements 22 and 23 are arranged with an arm extending in the same horizontal plane and outwardly from the frame unit SFU proper and each having one arm dependent therefrom as can best be seen in FIG. 4. The dependent arms of the elements 22 and 23 are provided with a plurality of aligned, spaced apart mounting slots 22S and 23S corresponding to the mounting slots for the mounting plates 10RP, 11RP, 10FP and 11FP respectively on the A-frames A. The mounting brackets for the A-frame A are provided for adjustably securing the frame SFU to the brackets 11FP and 11RP in accordance with the desired spacing avAilable by means of fasteners. The single frame unit SFU is secured to the brackets 11FP by means of the pair of front fasteners FF to be mounted in the openings 11FPA (illustrated in exploded relationship therewith) and into the desired mounting slots 23S on the frame unit SFU. Similarly, the rear fastener RF is secured to the slots 22S for the element 22 by means of the aperture for the rear mounting plate 11RP. The SFU frame is utilized for the end seating units of the booth system BS and therefore is provided with an upstanding leg or legs SUL that is secured to the plate 21 by means of a fastener 25 intermediate the ends thereof, as shown in exploded relationship in FIG. 4 and in a secured relationship in FIG. 1. The frame unit SFU is completed by means of a U-shaped seat back frame identified by the reference numeral 26. The U-shaped frame 26 is secured to the frame unit SFU at the right hand end or the outer end thereof as illustrated in FIG. 4 by means of the fasterners 27 and 28. The frame unit SFU can be upholstered or covered with a molded plastic seat base and molded backrest. In the drawings the frame unit SFU is illustrated as being upholstered by means of a seating unit USU secured to the top side of the elements 22 and 23 and with an upholstered backrest UBR secured to the back frame element 26. Suitable trim elements TR may be provided along the outside edges for the seating units as well as decorative U-shaped elements surrounding the frame 26 for the upholstered backrest UBR.

The double seating unit is constructed by means of a double frame unit DFU (see FIG. 4) which is generally of the same configuration as the single frame unit SFU but has a seating frame on opposite sides of the backrest frame 26. To this end for the purposes of the double frame unit DFU, the angular elements 22' and 23' are approximately doubled in length with respect to the elements 22 and 23 so that the backrest frame unit 26 is secured intermediate their ends, as is evident from examining the exploded relationship in FIG. 4. The cross members 20' and 21' for the double frame unit DFU are both illustrated as structural angle elements and are oriented in the same fashion as the angular elements 22 and 23 to form a rectangular frame. In this instance, the side faces adjacent each end of the elements 22' and 23' are provided with a plurality of adjusting apertures 22'S and 23'S arranged in a spaced, aligned relationship to correspond to the slots on the adjusting plates 10FP, 10RP, etc. for the A-frames A. Each side of the backrest frame element 26 when secured to the frame DFU then secures an upholstered or molded seat of conventional construction and identified as the element USU. Each upholstered seat USU is secured to the frame element DFU by means of suitable apertures provided in the element 22' and 23' and fasteners along with an upholstered backrest UBR secured to the backrest frame element 26. Suitable trim elements TR may be secured to the outside faces of the upholstered seating elements USU as indicated in FIG. 4 along with the decorative U-shaped element TR secured between the upholstered backrest elements UBR.

It should be recognized that the seating units SSU and DSU are assembled at the factory and shipped in assembled fashion to the point of use as a seating module. This then only requires that the modules be assembled to the A-frames A at the installation site as indicated in FIG. 1.

Now referring to FIG. 5, the typical section through a hollow structural element will be examined to show the manner of securing the elements together as well as the mounting feet 10M for the booth seating system BS. The hollow, square elements each include a plate 30 welded to the inside of the hollow structural element 26 which is shaped and threaded to receive a fastener 31. The shaped element 30 is defined with sufficient depth to securely hold the fastener 31 and the elements 23' and 26 together. The shaped plate 30 is secured a preselected distance D from the free end of the element 26 to allow the elements to be readily secured in the correct relationship.

The manner of assembling the modular units at the point of use should now be appreciated. The stacked A-frame elements A and the table tops T along with the required number of upholstered seating units can be readily uncrated and assembled at the point of use with a minimum of effort and inexpensive labor. For this purpose, the longitudinal dimension L which runs from center line to center line of the tables T is originally defined for the area in which the booth system BS is to be installed. The A-frame elements A are first spaced on the supporting surface with the center line of the A-frame elements A spaced in coincidence with the ends of the dimension L that has been preselected. This is to allow the booth system to be customized for the particular area available for such a booth seating system. The double seating units DSU then may be mounted on the A-frame rails 10 and 11 for the successive adjacent booths by resting them on the rails 10 and 11 and then securing them to the plates 11FP and 11RP, etc. into the particular adjusting apertures; see the right hand end of FIG. 1. It should be noted that the seating units DSU will be supported on the frames A without being secured thereto. This is done for each of the adjacent booth systems and then a single seating unit SSU is secured in the same fashion to the outside rail element 10 and 11, the left and right ends of the booth system BS as viewed in FIG. 1. The tables T may then be secured to the cantilevered arms 14 for the A-frame A at the cross members 15 and 16 by means of the fasteners provided therefor. It should also be noted that for the single seating units SSU the leg SUL must be secured on site to the frame element 21 to support the ends of the single seating units SSU.

I claim:

1. A universal table A-frame for a booth seating system constructed as a unitary structure comprising a pair of spaced apart frame rails adapted to be arranged in a parallel relationship and with their top surfaces defined in the same horizontal plane, a leg secured to each rail for maintaining the frame rails at a preselected vertical seating level and in the same horizontal plane and adapted to secure a seating structure thereto, an A-frame structure secured to each rail to secure the rails in a rigid upstanding relationship therewith, said A-frame structure comprising a pair of frame elements each being secured in a cantilevered relationship to each rail and disposed in an upwardly inclined relationship therewith and extending in a direction towards the other rail of said pair of rails, and table top mounting means secured to the free ends of said cantilevered frame elements for providing a unitary structure with said pair of frame elements and the pair of frame rails, said mounting means comprising a third frame element extending from said free ends of said pair of frame elements and being secured between the pair of frame rails in a preselected horizontal plane above the plane of the frame rails and adapted to secure a table top on said third frame element, the legs for each rail are constructed, defined and arranged with respect to the sides of each rail to position at least a pair of legs adjacent the same end of the frame rails adjacent the same preselected side of each rail to permit a plurality of said thus defined unitary table A-frames to be readily stacked in a nesting relationship.

2. A universal table A-frame for a booth seating system as defined in claim 1 wherein a leg for each rail is mounted in a flush relationship, in the same vertical plane as the rail, and the other leg for each rail is mounted in an off-set relationship, spaced from said vertical plane, therewith to permit a plurality of said thus defined unitary structured table A-frames to be readily stacked in a nesting relationship.

3. A universal table A-frame for a booth seating system as defined in claim 2 wherein said flush legs are secured to each rail adjacent to the rail ends securing said A-frame structure.

4. A universal table A-frame for a booth seating system as defined in claim 2 wherein said frame rails each include adjustable means secured to said other leg for each rail in an offset relationship for longitudinally and variably securing a seating unit adjacent each end of the rails in a preselected vertical seating level and still permit said table A-frames to be readily stacked in a nesting relationship.

5. A universal table A-frame for a booth seating system as defined in claim 4 wherein said means for adjustably securing a seating unit each include a longitudinally slotted plate secured adjacent each end of the rails and each terminating at the same horizontal plane.

6. A universal booth seating system comprising a unitary frame structure for mounting booth seating means in oppositely facing directiosn for the same booth, said unitary frame structure comprising a pair of spaced apart frame rails adapted to be arranged ina parallel relationship and with their top surfaces defined in the same horizontal plane, a leg secured to each rail for maintaining the frame rails at a preselected vertical seating level and in the same horizontal plane, an A-frame structure comprising a pair of frame elements each being secured in a cantilevered relationship and disposed in an upwardly inclined relationship therewith and extending in a direction towards the other rail of said pair of rails, said A-frame including table top mounting means secured to the free ends of said cantileered frame elements for completing the unitary frame structure, said table top mounting means comprising a third frame element extending in a cantilevered relationship from said free ends of said pair of frame rails in a preselected horizontal plane above the plane of the frame rails and adapted to secure a table top on said third frame element, a table top secured to said table top mounting means, and a pair of booth seating means secured to an individual one of said frame rails with each of the booth seating means facing in opposite directions on opposite sides of the table top for defining a single booth.

7. A universal booth seating system as defined in claim 6 wherein each of said seating means comprises seat frame means constructed and defined for securing a booth seating structure and booth seating back structure, and booth seating structure means secured to said seat frame seating structure and seating back means secured to said seating frame seating back structure.

8. A universal booth seating system as defined in claim 6 including a second similarly defined unitary frame structure arranged in spaced longitudinal alignment with the first mentioned frame structure for defining a second booth seating system and having a second table top similarly secured to said second similarly defined unitary frame structure, one of said pair of seating means secured to an individua one of said frame rails comprising seat frame means constructed and defined for securing a double seating structure and double seating back structure, said seat frame means being longitudinally and adjustably secure between the first and second aligned frame structures with the seating back structure extending therefrom and in between said aligned frame structures, and booth seating means and booth seat back means both secured to said seat frame means on opposite sides of said seating back structure, and single booth seating means secured to said unitary frame structure on the opposite side of the second table top from the latter mentioned double seating means to completely define a second booth seating system.

9. A universal booth seating system as defined in claim 8 wherein said frame rails for the first and second unitary frame structures each include adjustable means for longitudinally and variably securing a seating unit adjacent each end of the rails in a preselected horizontal seating level.

10. A universal booth seating system as defined in claim 9 wherein said adjustable securing means comprise a slotted plate secured adjacent each end of the rails for the first and secondary unitary frame structures and each terminating at the same horizontal level, and the slotted plae having a plurality of longitudinally aligned, spaced securing slots, and said seat frame means including a plurality of longitudinally aligned, spaced securing slots to permit the longitudinal distance between successive booths to be adjustable.

11. A universal booth seating system as defined in claim 6 wherein said seating means each comprise an upholstered pre-assembled unit having an upholstered seating unit and back rest upholstered unit.

12. A universal booth seating system as defined in claim 8 wherein said frame rails and said seating means are constructued and defined to permit the rails and seating means to be adjustably secured to one another so that the longitudinal extent of the boooths may be adjustably varied.

13. A universal booth seating system comprising a first unitary frame structure for mounting seating means in oppositely facing directions for the same booth and a table top mounting means extending in a cantilevered fashion from one end of the frame for mounting a table top, a secondary unitary frame structure constructed and defined the same as the first unitary frame structure and spaced a preselected distance therefrom, each of said frame structures, including means for permitting same to be longitudinally adjustable secured to one another to permit the seating system to fit within a preselected length, a pair of single seating module means adapted to be adjustably secured to said unitary frame structures, one of the seating modules being adjustably secured to the outer end of the first unitary frame structure with the other one of the seating modules adjustably secured to the outer end of the second unitary frame structure, a double seating module means adapted to be adjustably secured between said first and second frame structures, and individually table tops for the first and second frame structures individually secured to the table top mounting means for said frame structures.

14. A universal booth seating system as defined in claim 13 wherein said seating module means each comprise upholstered seating means having an upholstered back resting means.

15. A universal table A-frame for a booth seating system as defined in claim 1 wherein said A-frame structure is secured to each rail adjacent the same ends thereof to secure the rails in a rigid upstanding relationship therewith and thereby defining a modular unitary structure.

16. A universal booth seating system as defined in claims 6 to 8 wherein said A-frame structure is secured to each rail adjacent the same ends thereof to secure the rails in a rigid upstanding relationship therewith.

* * * * *

UNITED STATES PATENT AND TRADEMARK OFFICE

CERTIFICATE OF CORRECTION

PATENT NO. : 4,850,642

DATED : July 25, 1989

INVENTOR(S) : Scott D. Crowe

It is certified that error appears in the above-identified patent and that said Letters Patent is hereby corrected as shown below:

Column 3, line 45, "relat" should read -- relationship --.
Column 4, line 11, delete colon and substitute a period therefor.
Column 4, line 34, after "rail", insert -- 10 --.
Column 5, line 56, "avAilable" should read -- available --.
Column 8, line 1, "unitary" should read -- unitarily --.
Column 8, line 22, "directiosn" should read -- directions --.
Column 8, line 24, "ina" should read -- in a --.
Column 8, line 61, "individua" should read -- individual --.
Column 9, line 18, "plae" should read -- plate --.
Column 9, line 29, "constructued" should read -- constructed --.
Column 9, line 31, "boooths" should read -- booths --.
Column 10, line 32, "to" should read -- or --.

Signed and Sealed this

Eighth Day of January, 1991

*Attest:*

HARRY F. MANBECK, JR.

*Attesting Officer*

*Commissioner of Patents and Trademarks*